US007147462B2

(12) United States Patent
Bunting

(10) Patent No.: US 7,147,462 B2
(45) Date of Patent: Dec. 12, 2006

(54) POCKET READOUT APPARATUS

(76) Inventor: John E. Bunting, 75 Scobie Rd., New Boston, NH (US) 03070

( * ) Notice: Subject to any disclaimer, the term of this patent is extended or adjusted under 35 U.S.C. 154(b) by 214 days.

(21) Appl. No.: 10/911,390

(22) Filed: Aug. 4, 2004

(65) Prior Publication Data

US 2005/0199080 A1 Sep. 15, 2005

Related U.S. Application Data

(60) Provisional application No. 60/492,527, filed on Aug. 5, 2003.

(51) Int. Cl.
*F23N 5/00* (2006.01)

(52) U.S. Cl. ..... 431/13

(58) Field of Classification Search ..... None
See application file for complete search history.

(56) References Cited

U.S. PATENT DOCUMENTS 4,402,663 A * 9/1983 Romanelli et al. ..... 431/66
4,833,398 A * 5/1989 Buchan ..... 219/509
5,672,964 A * 9/1997 Vinci ..... 324/72.5
5,761,092 A * 6/1998 Bunting ..... 702/185
6,281,686 B1 * 8/2001 Hawkins, Sr. ..... 324/555

* cited by examiner

*Primary Examiner*—Robert Raevis
(74) *Attorney, Agent, or Firm*—William B. Ritchie

(57) ABSTRACT

A readout apparatus that can be carried in the shirt pocket of a technician. The readout apparatus is used to easily and quickly make a connection to a heating system via a data access port of the heating controls, especially in low light situations, without the need for cables or probes. A display enables a technician to determine information concerning the operational characteristics of the heating system control unit to obtain information concerning the operational characteristics of the heating system. Real time operational information concerning the operation of the heating system via its control unit such as well temperature, cad cell, and line voltage are provided. The apparatus is powered from the electrical power available at the data access port so that the apparatus does not require the use of batteries or need any external switching such as an on/off button.

9 Claims, 3 Drawing Sheets

POCKET READOUT APPARATUS

This application claims benefit of priority under 35 U.S.C. §119(e) to U.S. Provisional Application Ser. No. 60/492,527, filed on Aug. 5, 2003.

FIELD OF THE INVENTION

This invention relates to heating system controls, in particular, an apparatus that can be used to obtain data from data ports of heating system controls.

BACKGROUND OF THE INVENTION

Heating control systems such as those manufactured by Honeywell provide data port access so that data may be taken by service personnel to ascertain the operational characteristics of the heating system.

For example, the cadmium disulfide cell (cad cell) on Honeywell Model R7184 can be evaluated by a technician; however, the process is quite difficult. In this case, the technician must remove the R7184 from its mount, and detach the two wires that are going to the cad cell. Then, a jumper wire must be placed between the two terminals and an ohmmeter is then connected to the two wires to determine a reading.

In order to determine the water temperature in the well of boilers equipped with Honeywell Model Nos. L7124 or L7148, considerable disassembly of the respective units is required. The well of a boiler is a fitting that protrudes into the water jacket of the boiler. The temperature sensor that measures the water temperature of the boiler is customarily placed within the well. The well is typically located directly behind the boiler control. Consequently, access to this sensor is blocked by the boiler control unit making measurement of this important parameter very difficult using present methods.

If the technician needs to measure the microamps on the flame rectification circuit of a gas burner, a wire must first be disconnected and then a microamp meter must be connected into the circuit.

To measure the line voltage of a burner circuit, the technician must first set up a voltmeter using cables and probes. Next, a point of access and a neutral must be found. Only then can the technician read the voltage of the burner circuit.

SATROPEN manufactured by Satronic AG of Honeywell—Platz 1, CH-8157, Dielsdorf, Switzerland, is a hand-held device that collects data via infrared from the controller of the burner circuit. This device is self-powered by batteries and shows flame strength measured as a percentage with 100% being required for proper operation. It does not interpolate line voltage, nor is it plugged into the data port of the burner. Further, it does not display cad cell value in ohms as this parameter is transmitted.

At present, there is not found in the prior art, a device which can be used to easily and quickly make a connection to a data access port of a heating control system, especially in low light situations, without the need for cables or probes, using an apparatus that can be easily carried in the shirt pocket of the technician.

SUMMARY OF THE INVENTION

It is an aspect of the invention to provide a readout apparatus that can be carried in the shirt pocket of a technician.

It is another aspect of the invention to provide a readout apparatus that is powered by the voltage available from the data access port of a heating system control unit, thereby eliminating the need for batteries that would have to be periodically replaced as well as the need to carry spares.

It is still another aspect of the invention to provide a readout apparatus that has a cap to seal any connective openings when the apparatus is not in use.

Another aspect of the invention is to provide a readout apparatus that has a clip that enables the apparatus to be attached to the technician's shirt pocket.

Still another aspect of the invention is to provide a readout apparatus that is convenient and easy to hold with one hand so that it can be used in low light situations, thereby permitting the free hand of the technician to hold a worklight.

It is another aspect of the invention to provide a readout apparatus that is adapted to be easily attached to the data ports of Honeywell Model Nos. L7184 and L7124.

Another aspect of the invention is to provide a readout apparatus that provides real time operational information concerning the operation of the heating system via its control unit such as well temperature, cad cell, and line voltage.

It is also an aspect of the invention to provide a readout apparatus that can be used with either a gas or oil heating system.

Finally, it is an aspect of the invention to provide a readout apparatus that can merely be plugged into the data port access of a heating system control unit to obtain information concerning the operational characteristics of the heating system.

DETAILED DESCRIPTION OF THE INVENTION

Figure 1:
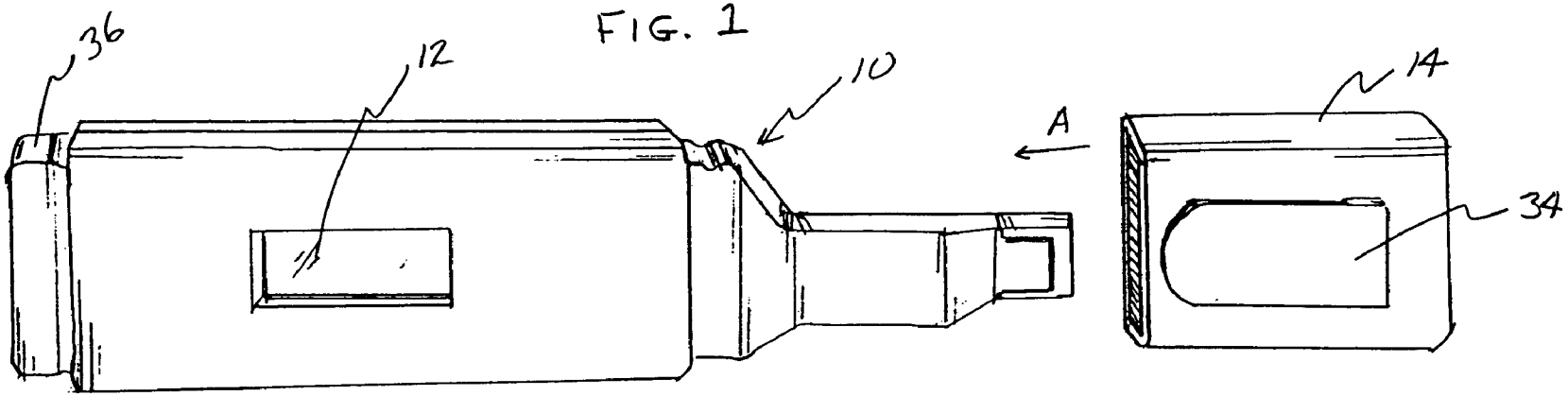
FIG. 1 is an isometric view of the readout apparatus in accordance with the invention.

As shown in the accompanying figures, the readout apparatus 10 is made up of two halves, top housing 20 and bottom housing 26. The respective housings are preferably injected molded of oil resistant plastic and assembled together with tamper resistant screws (not shown) through screw openings 30 into screw posts 22. Invention 10 is sized so that it can be conveniently stored in a technician's pocket. Typically, invention 10 is about 5 inches long and 1 inch wide.

Top housing 20 is fitted with window 24 which can be provided with a lens. Window 24 is positioned directly above LCD display 32 which is mounted in printed circuit board 28 which is shown in bottom housing 26.

Figure 2:
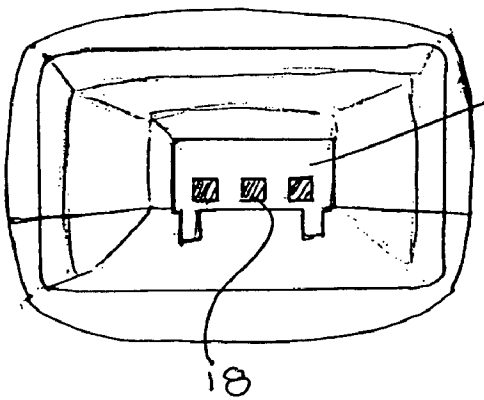
FIG. 2 is a detailed front view of the connection port.
Figure 3:
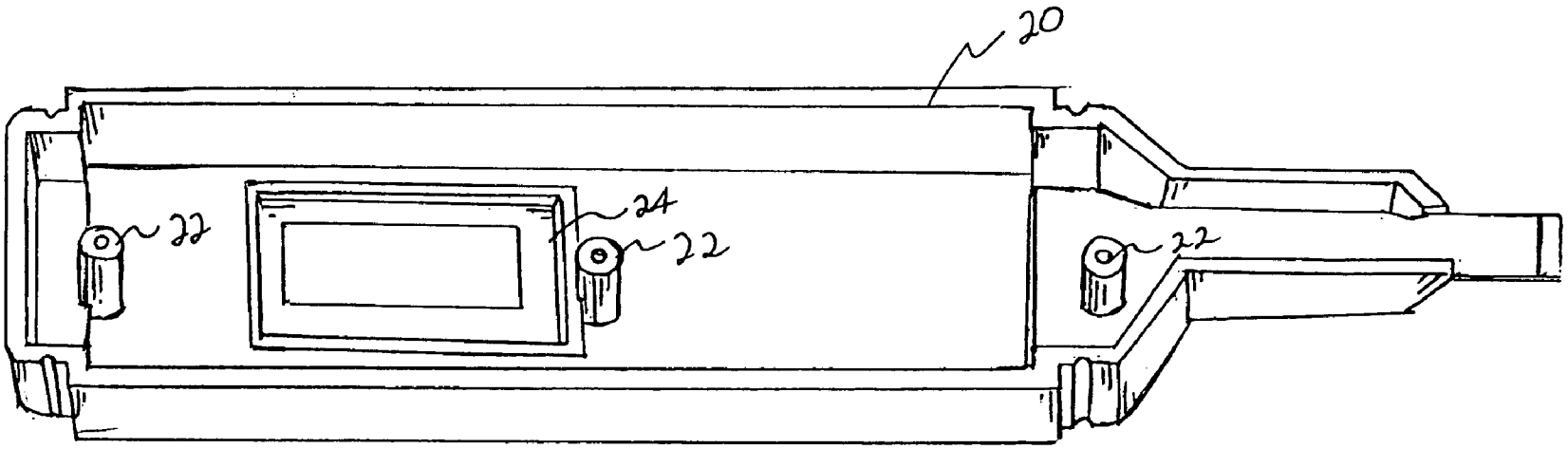
FIG. 3 is inside view of the top housing.
Figure 4:
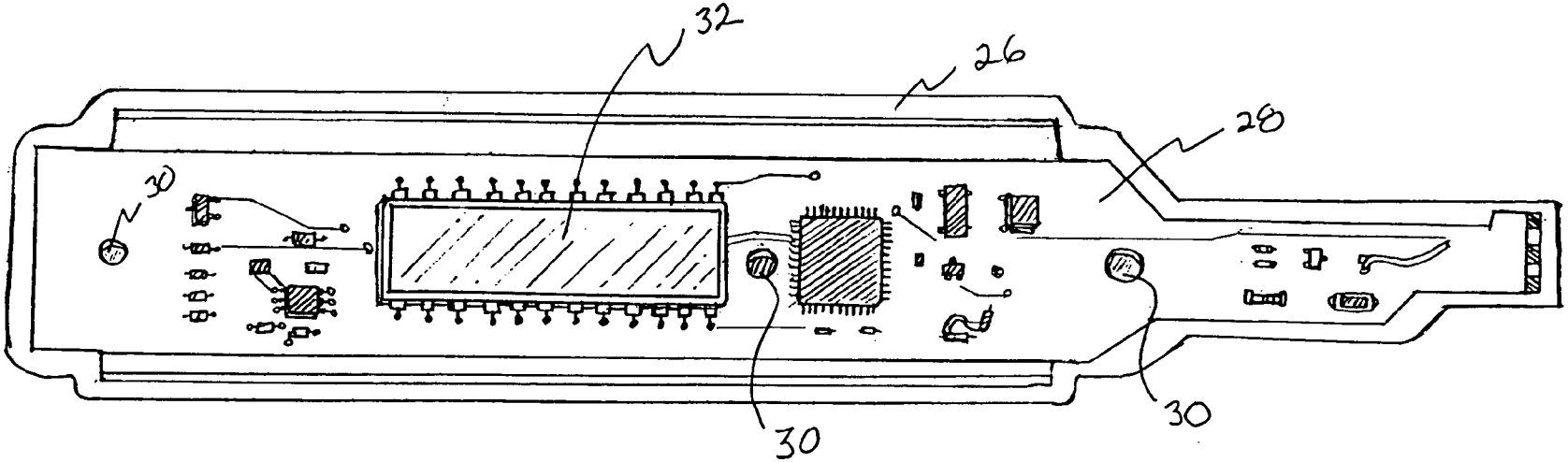
FIG. 4 is an inside view of the bottom housing with the printed circuit board in place.

One end of invention 10 is fitted with connection plug 16. This is shown in detail in FIG. 2 as viewed in direction A shown in FIG. 1. Connection plug 16 is shown fitted with three openings 18 which can make an electrical connection with the three prongs provided by the data port of the heating system control unit (not shown). Of course, the shape of connection plug and the number and type of contacts will depend on the particular data port that the invention is being used to evaluate.

Cap 14 is also molded plastic, preferably the same plastic as used to make top and bottom housings 20, 26. When top and bottom housings 20, 26 are fitted together, the two halves are shaped such that cap 14 is retained when it is placed over the connection plug end or on end 36 so that it can be stored when the invention is being used. Thus, when invention 10 is in the technician's pocket or toolbox, cap 14 will protect the electrical contact end and its connection plug 16 from being contaminated with dirt. Clip 34 is provided on cap 14 so that invention 10 can be conveniently attached to the technician's shirt pocket in the same manner as a pen.

Printed circuit board 28 is dimensioned to fit totally within the housing. It uses circuitry well known in the art and consists of the following subcircuits: a voltage regulator, a microcontroller, LCD display 32, a voltage determination circuit and a communications conditioning circuit. However, if additional data measurements are later required, printed circuit board 28 can be easily adapted to meet these requirements.

The voltage regulator circuit features' components reduce the incoming voltage (customarily 24 volts) to approximately 3 volts, which is voltage used by invention 10.

The microcontroller is preferably the type made by Texas Instruments Model No. MSP430F4121PM, however, other comparable devices could also be used. The microcontroller receives data from the data port and processes the data to determine which heating system control unit is providing the data. It then processes this data to obtain the pertinent information (for example, ohms or water temperature). Using the nominal 24 volt supply, it interpolates the actual line voltage of the burner or boiler circuit and then sends the appropriate signals to the LCD display 32 for viewing by the technician. LCD display 32 is preferably Model No. p/n 04-0858-00 as made by DCI, Inc., however, other comparable products could be substituted.

Using the invention 10 in conjunction with a Honeywell R7184 heating system control unit, a technician can determine the cad cell ohms of the oil burner system and the line voltage of the burner circuit, as provided by the data port.

The technician will plug the connection plug 16 into the data port and wait a few seconds, to a maximum of 8 seconds. LCD display 32 on the readout apparatus 10 will alternate between the ohms reading, as transmitted by the R7184, and the line volts, as derived from the nominal 24 volt output of the R7184. As the two values change, display 32 will show the latest figures. The "ohms" reading is transmitted every 8 seconds by the R7184 and the line volts are determined by invention 10 every 8 seconds.

As the burner runs, the "ohms" reading can vary due to the quality of the flame as seen by the cad cell. This changing value will be transmitted and displayed for viewing by the technician. The "ohms" value of the cad cell circuit is important in setting up a burner during routine service and in diagnosing operational problems.

Sufficient line voltage on the burner's electrical circuit is vital for proper operation of a burner. Readout apparatus 10 is a very convenient method of determining that value. A technician need not take out a voltmeter, locate an access point to the boiler control electrical circuit, nor locate an access point to the neutral side of the electrical system, using cables and probes, in order to read the voltage.

Using invention 10 in conjunction with a Honeywell L7124 or L7148 boiler control, the technician can determine the temperature of the boiler water in the "well" and the line voltage of the boiler control circuit, as provided by the data port. As noted above, the "well" is a fitting that protrudes into the water jacket of the boiler and is where the temperature sensor of the boiler control is located.

As before, connection plug 16 is plugged into the data port. The technician then waits a few seconds, to a maximum of 8 seconds. The LCD display 32 on the printed circuit board 28 will alternate between the water temperature reading, as transmitted by the L7124 or L7148, and the line volts, as derived from the nominal 24 volt output of the boiler control.

As the two values change, the display 32 will show the latest figures. The water temperature reading is transmitted every 8 seconds by the Honeywell products; the line voltage is determined by the device every 8 seconds.

As the boiler operates, knowing the water temperature is vital to knowing if a heating system is operating properly. The temperature of the water determines when the boiler control will signal that the burner should operate to produce more heat. The technician must know if the water temperature, as sensed by the boiler control, corresponds correctly with the actual temperature shown by the thermometer on the boiler. If there is a discrepancy, it could mean that the boiler control is malfunctioning or the well area is insulated from the water by corrosion or other build up. Both problems can be safety issues.

Knowledge of the water temperature, as sensed by the boiler control, is vital when setting up a heating system during routine service and during unscheduled service calls.

Using invention 10 in conjunction with a gas heating system control that utilizes flame rectification to determine the presence of flame in a burner and that has a data port, the technician can determine the microamps present on the circuit as provided by the data port.

Again, the technician merely plugs the connection plug 16 into the data port and waits a few seconds. The LCD display 32 will alternate between the microamps reading, as transmitted by the burner control, and the line volts, as derived from power available from the data port.

As the burner runs, the microamps reading can vary due to the quality of flame as detected by the flame rectification circuit. This changing value will be transmitted to, and displayed by, the device. The microamps value is important in setting up a burner during routine service and in diagnosing operational problems.

As noted above, sufficient line voltage on the burner's electrical circuit is vital for proper operation of a burner.

Although the present invention has been described with reference to certain preferred embodiments thereof, other versions are readily apparent to those of ordinary skill in the art. Therefore, the spirit and scope of the appended claims should not be limited to the description of the preferred embodiments contained herein.

What is claimed is:

1. An apparatus for measuring the operational characteristics of a heating system via a data access port in a heating system control unit for said heating system having a cad cell, said apparatus comprising:

a housing that is adapted to fit within the shirt pocket of a user;

a printed circuit board sized to fit within said housing wherein said printed circuit board is powered by said control unit;

a display associated with said printed circuit board that displays data that is processed by said printed circuit board;

a plug-in connection adapted to be inserted into the data access port wherein the operational characteristics of the heating system are provided to said user and wherein said apparatus is powered by said heating system via said data access port.

2. The apparatus of claim 1 wherein said display indicates a cad cell value in ohms which serves to provide a measure of the quality of the flame that is detected by the cad cell.

3. The apparatus of claim 2 wherein said apparatus interpolates the actual line voltage in real time of said heating system.

4. The apparatus of claim 3 wherein said apparatus measures the well temperature of said heating system.

5. The apparatus of claim 4 that is dimension so that said apparatus can be carried in the shirt pocket of a technician.

6. The apparatus of claim 5 further comprising a clip that enables the apparatus to be attached to the technician's shirt pocket.

7. The apparatus of claim 6 wherein said apparatus can be held and operated by one hand thereby permitting the free hand of the technician to hold a work light such that said apparatus can be used in low light situations.

8. The apparatus of claim 7 wherein said apparatus can be used with either a gas or oil heating system.

9. The apparatus of claim 8 further comprising a cap to seal any connective openings when the apparatus is not in use.

* * * * *